US005901715A

United States Patent [19]

Cambon et al.

[11] Patent Number: 5,901,715

[45] Date of Patent: May 11, 1999

[54] CONTAINER FOR COSMETIC PRODUCTS AND THE LIKE

[75] Inventors: Alain Cambon, Varet; Pascal Genelot, Lapevrusse, both of France

[73] Assignee: S.E.R.I.C.A.—Services Etudes et Realisations Industrielles par Moulage du Cantal, Jussac, France

[21] Appl. No.: 08/968,580

[22] Filed: Nov. 13, 1997

[51] Int. Cl.[6] ..... A45D 33/26

[52] U.S. Cl. ..... 132/293; 206/446; 220/515

[58] Field of Search ..... 132/286, 293; 206/446, 581; 215/6, DIG. 7; 220/513, 515, 516, 517, 518, 509, 740

[56] References Cited

U.S. PATENT DOCUMENTS

| | | | |
|---|---|---|---|
| 2,682,949 | 7/1954 | Whitehead | 206/446 |
| 3,256,892 | 6/1966 | Esposito, Jr. | 132/300 |
| 3,552,402 | 1/1971 | Levy | 132/293 |
| 4,054,221 | 10/1977 | Glover | 215/235 |
| 4,681,127 | 7/1987 | Gueret | 132/301 |
| 4,821,751 | 4/1989 | Chen | 206/581 |
| 5,460,288 | 10/1995 | Balzeau | 132/293 |
| 5,474,199 | 12/1995 | Julius et al. | 220/339 |
| 5,690,246 | 11/1997 | Anderson et al. | 206/446 |

FOREIGN PATENT DOCUMENTS 1320208 5/1963 France .

*Primary Examiner*—Gene Mancene
*Assistant Examiner*—Eduardo C. Robert
*Attorney, Agent, or Firm*—McDermott, Will & Emery

[57] ABSTRACT

A container for cosmetic products that includes a base, a cover, and a connector to link the base and the cover together. The connector includes at least one elastic strip having a first end coupled to the base and a second end hinged to the inside of the cover in the vicinity of the interface between the base and the cover. The connector is such that when the cover is placed on the base, the connector is not visible on the outside of the container.

5 Claims, 1 Drawing Sheet

CONTAINER FOR COSMETIC PRODUCTS AND THE LIKE

TITLE OF THE INVENTION

1. Field of the Invention

This invention is related to a container for cosmetic products or and the like, of a type that includes a body that makes up the base, a body that makes up the cover, and connectors to link the two bodies together.

2. Brief Description of Related Art

In general, the connectors are composed of a hinge that sticks out and therefore is visible or by a hinge positioned on the inside but which then requires a groove in one of the bodies at the joining surface for the release necessary to rotate the cover.

BRIEF SUMMARY OF THE INVENTION

The main purpose of this invention is to correct these disadvantages by the use of connectors that are completely invisible from the outside.

To do this, the connectors according to the invention are composed essentially of at least one elastic strip, one end of which is one piece with one of the bodies, and the other end of which is hinged to the inside of the other body in the vicinity of the surface joining the two bodies.

With this arrangement, as will be seen more clearly below, it is possible to achieve an invisible and completely joined connection of the two bodies, without any visible slack or groove.

In one particular form of the invention, the elastic strip is hinged to the body that makes up the cover.

Preferably, the elastic strip is positioned roughly parallel to the surface joining the two bodies.

In an application of the invention specific to a container for a perfume bottle, the body that makes up the base includes an inner collar, to which the end of the elastic strip that is not hinged to the body forming the cover, is attached.

BRIEF DESCRIPTION OF THE DRAWINGS

One form of implementing the invention is described below as an example, with reference to the attached diagram, in which.

DETAILED DESCRIPTION OF THE INVENTION

Figure 1:
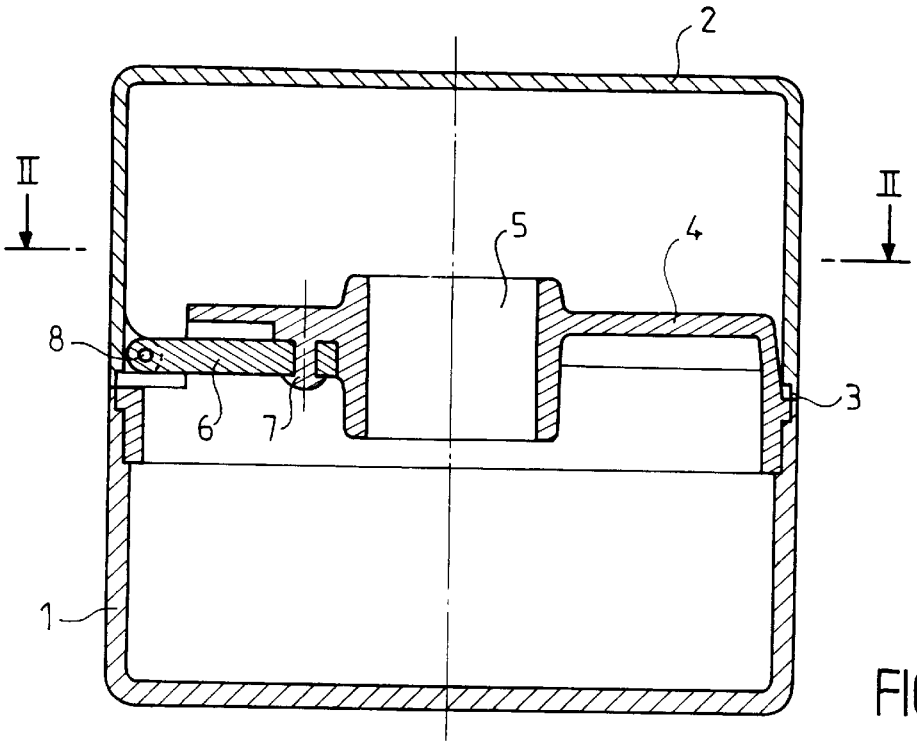
FIG. 1 is a vertical section of a container in accordance with the invention intended to hold a perfume bottle.
Figure 2:
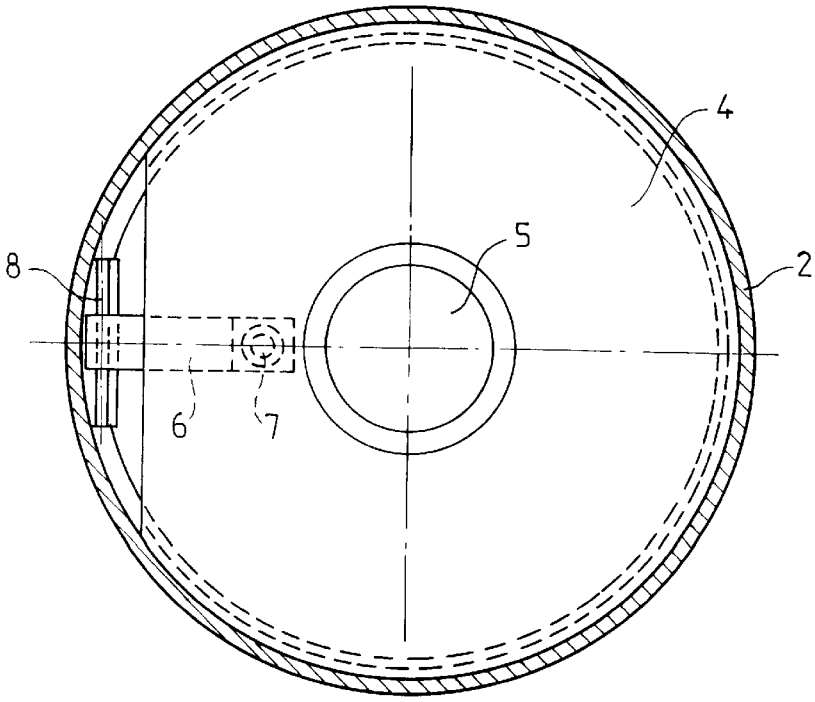
FIG. 2 is a horizontal section according to line II—II of FIG. 1.

The container represented in FIGS. 1 and 2 is generally cylindrical and is composed mainly of a lower body 1, forming the base, and an upper body 2 forming the cover, with a joining surface 3 between the two.

The particular example described here involves a container that is used as the packaging for a perfume bottle. For this the lower body 1 is provided with a detachable inner collar 4 with a central groove 5 for the passage of the neck of the perfume bottle; this collar thus keeps the above mentioned bottle in place in the base.

In accordance with the invention, the cover 2 is connected to the base 1 by an elastic strip 6, positioned parallelly to the surface 3 joining the base with the cover, one end of which is attached rigidly to the collar 4 by a rivet 7, and the other end of which is hinged to the inner wall of the cover 2 by a pin 8 located in the vicinity of the joining surface 3.

To open the container, pulling the cover 2 slightly upwards in the opposite way from the hinging pin 8 is sufficient. In doing this, the elasticity of the strip 6 is induced and at the same time draws the pin 8 towards the inside; this makes possible normal rotation of the cover 2. In addition, it should be noted that putting the elastic strip 6 under tension causes a strain when the cover is closed and hinders its natural opening if the unit is returned.

The elastic strip 6 will be composed expediently of a molded plastic material that allows a certain number of strains without losing its mechanical qualities or experiencing stretching that is harmful to good operation over time. As for the other parts of the container, that is, mainly the bodies and the collar, they may also be made of plastic, but they can be made of metal or another suitable material as well.

This invention thus makes it possible to link a base and its cover simply and inexpensively with a connection that is completely invisible from the outside and does not have any visible slack on the joining surface 3. It can be used particularly beneficially in packaging for cosmetic or perfume products, including make-up cases, but it goes without saying that it can also be used advantageously any time there is a desire to make a base and its cover as one piece without a visible hinge.

We claim:

1. A container for cosmetic products, said container comprising:

a base having an internal section and an outer surface, a cover having an inner surface and an outer surface, and at least one elastic connector coupling said cover to said base, said elastic connector having a first end coupled to said internal section of said base and a second end rotatably coupled to said inner surface of said cover, wherein when said cover is disposed on said base, said outer surface of said cover and said outer surface of said base form a surface void of an opening or a grooves, and said elastic connector is not visible.

2. The container for cosmetic products according to claim 1, wherein said elastic connector extends substantially parallel to a surface defined by the interface between said cover and said base.

3. The container for cosmetic products according to claim 1, wherein said second end of said elastic connector is hinged to said cover utilizing a pin.

4. The container for cosmetic products according to claim 3, wherein said elastic connector extends substantially parallel to a surface defined by the interface between said cover and said base.

5. The container for cosmetic products according to claim 3, wherein said internal section of said base comprises an inner collar, said first end of said elastic connector being coupled to said inner collar.

* * * * *